US007666105B2

(12) United States Patent
Ball et al.

(10) Patent No.: US 7,666,105 B2
(45) Date of Patent: Feb. 23, 2010

(54) OPEN SIDED BILLIARD RACK

(75) Inventors: Arthur W. Ball, Plano, TX (US); James R. Plichta, 1504 Brazos Trail, Plano, TX (US) 75075

(73) Assignee: James R. Plichta, Plano, TX (US)

( * ) Notice: Subject to any disclaimer, the term of this patent is extended or adjusted under 35 U.S.C. 154(b) by 0 days.

(21) Appl. No.: 11/726,187

(22) Filed: Mar. 21, 2007

(65) Prior Publication Data

US 2008/0234060 A1 Sep. 25, 2008

(51) Int. Cl.
*A63D 15/00* (2006.01)

(52) U.S. Cl. ..... 473/40; 473/26

(58) Field of Classification Search ..... 473/40, 473/26, 41; D21/782
See application file for complete search history.

(56) References Cited

U.S. PATENT DOCUMENTS

| | | | | | |
|---|---|---|---|---|---|
| 743,464 | A | * | 11/1903 | D'Ambramo | 473/40 |
| 1,660,626 | A | * | 2/1928 | Rhoads | 473/40 |
| 1,725,494 | A | * | 8/1929 | Varnum | 473/40 |
| D240,943 | S | * | 8/1976 | Kremsi | D21/782 |
| 3,992,005 | A | * | 11/1976 | Richey | 473/40 |
| 4,469,328 | A | * | 9/1984 | Pacitti | 473/40 |
| 5,997,404 | A | | 12/1999 | Sardo | |
| 6,261,187 | B1 | * | 7/2001 | Tsai | 473/40 |
| 6,312,342 | B1 | * | 11/2001 | Newsome | 473/40 |
| D480,775 | S | * | 10/2003 | Fischer | D21/782 |
| 7,166,033 | B2 | * | 1/2007 | Krajeski | 473/40 |
| 7,192,358 | B2 | * | 3/2007 | Knupp | 473/40 |

OTHER PUBLICATIONS

Excerpts from website www.tightrack.com showing Sardo M-5000 rack with top down ball positioner.
Excerpts from website www.gamesroomusa.com showing Sardo M-3000 rack with top down ball positioner.

* cited by examiner

*Primary Examiner*—Mitra Aryanpour

(57) ABSTRACT

A billiard rack and method using the rack defining V-shaped ball containment area having a pair of arms each having an outer and inner side, where said arms meet at an apex and have extremities away from the apex that create an arc of approximately 60 degrees, the inner side of each arm extending at least as far as a distance equal to five times the diameter of a standard billiard ball and the outer side or each arm extending at least as far as the distance equal to four times the diameter of a standard billiard ball that is accessible from the top. The radius of curvature of the apex preferably is 1⅛ inches and the distance between the ends of each inner side of each arm is 13⅝ inches and the outer side is 14⅛ inches. In a preferred method, the balls are racked by the user with two thumbs pressing against the balls and the rack is removed by forward movement away from the balls without disturbing the balls.

14 Claims, 3 Drawing Sheets

OPEN SIDED BILLIARD RACK

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

FIELD OF THE INVENTION

The present invention relates to billiard racks for pool or billiard balls and more particularly to an open sided billiard rack.

BACKGROUND OF THE INVENTION

In the racking of pocket pool or billiard balls prior to the initiation of play, the balls are traditionally placed in a triangular rack, the head ball located on the appropriate spot, the balls forced toward the front of the rack with the fingers (generally the thumbs) and the rack vertically and carefully removed from about the balls. During the removal of the rack from about the balls, it is not uncommon that one or more portions of the rack contacts the balls causing the rack to "loosen". The occurrence of such a condition requires that the balls be "re-racked" until a tight i.e. all balls touching, rack is achieved. The traditional racking system is a simple triangular wooden or synthetic material that has an enclosed area slightly larger than the area taken up by the racked balls. One of the main deficiencies is that upon removal, it is very common to make contact with one or more balls and thus undo the tight rack that formerly was contained in the triangular form.

One prior art solution that attempted to improve on this system is found in U.S. Pat. No. 6,312,342 to Newsome entitled "Billiard Rack." This patent discloses a pocket pool or billiard rack that incorporates in its rearmost side outwardly and angularly extending lever portions that permit upward rotation of the billiard rack upon the application of downward pressure with the thumbs or other fingers prior to removal of the billiard rack about the balls in the ball racking operations. However, it is still possible with this racking system to inadvertently touch one or more balls and thus disturb the racked balls. It also requires significant manual dexterity to operate which may be lacking with those who play pool for a variety of reasons.

Another prior art solution is shown in U.S. Pat. No. 5,997,404 to Sardo entitled Racking System for Arranging Pool Balls. This patent shows a racking device that conforms to the shape and size of each individual pool ball that utilizes a plurality of sweeper pins to move the pool balls together into a tight formation, such that adjoining balls touch each other. The balls are then firmly pressed into the felt of the pool table by a plurality of pressure pins. Once the desired formation has been achieved, the racking device is removed without disturbing the racked pool balls. This fails to show a simple two sided V-shaped rack of the present invention.

Another prior art solution is to another racking system sold under the name THE SARDO TIGHT RACK®, among others models SARDO M-5000, M-3000, AND M-2000. The SARDO M-5000 is a V-shaped rack with a mating triangular top portion for centering and positioning the balls and may be used with 9 or 15 balls. This system requires a downward motion by the upper triangular shaped body that engages the balls directly upon downward pressure and thereby positions and racks the balls. The balls are racked in the same and may have the effect of preventing a random racking as with a conventional system. Its configuration prevents ready access to the balls from the side and does not show the inventive benefits of the present invention.

The design of a rack that permits even the most inexperienced player to properly rack the balls without the possibility of "loosening" the rack in the process of removal of the billiard rack would be of significant benefit to the pool and billiard playing community.

ADVANTAGES OF THE INVENTION

It is therefore an advantage of the present invention to provide a pocket pool or ball billiard rack that allows even the most inexperienced player to properly rack the balls before the onset of play.

It is another advantage of the present invention to provide a ball billiard rack that moves out of contact with the balls during the racking operation rather than requiring vertical removal of the rack from about the balls.

It is yet another advantage of the present invention to provide a ball billiard rack that easily moves out of the way of the balls without significant vertical movement of the rack and added potential for nicking a ball while being removed.

SUMMARY OF THE INVENTION

In accordance with a preferred embodiment of the invention, there is shown a billiard rack having a V-shaped ball containment area having a pair of arms each having an outer and inner side, the arms meeting at an apex having an inner and outer surface, the arms extending from the apex to create an arc of approximately 60 degrees, the inner side of each arm extending at least as far from the inner surface of the apex a distance equal to approximately five times the diameter of a standard billiard ball, said outer side of each arm extending at least as far from the outer surface of the apex a distance equal to four times the diameter of a standard billiard ball.

In accordance with another preferred embodiment of the invention, there is disclosed a billiard rack defining V-shaped ball containment area having a pair of arms forming a V where each arm has an outer and inner sides, a connecting side between the outer and inner sides, the arms meeting at an apex and having extremities away from the apex that create and arc of approximately 60 degrees, the inner side of each arm extending at least as far as a distance equal to 4 times the diameter of a standard billiard ball, the outer side or each arm extending at least as far as the distance equal to five times the diameter of a standard billiard ball, and a connecting side that joins the inner and outer sides In accordance with another preferred embodiment of the invention, there is disclosed a billiard rack having a V-shaped ball containment having a pair of arms having a generally rectangular cross section each arm having an outer and inner side, and a top and bottom side, the arms meeting at an apex having an inner and outer surface, the arms extending from the apex to create an arc of approximately 60 degrees, the inner side of each arm extending at least as far from the inner surface of the apex a distance equal to approximately five times the diameter of a standard billiard ball, and the outer side of each arm extending to the farthest end of the inner surface.

In accordance with another preferred embodiment of the invention, there is disclosed a method for racking balls having the steps of placing a V-shaped open top billiard containment device on a pool table, moving 15 billiard balls into said V-shaped device into the opening of the V into a tight formation engaging the sides and apex of said V-shaped device, and moving said V-shaped device away from said balls in the horizontal plane of the table until said V-shaped device is completely removed from about the balls, thereby leaving the balls in a tight triangular formation.

DETAILED DESCRIPTION OF THE PREFERRED EMBODIMENTS

The billiard rack of the present invention permits upward rotational removal thereof from about the periphery of pocket pool or billiard balls located therein for racking and location on the playing surface. This design permits even the most inexperienced player to properly rack the balls without accidentally striking one or more of the balls during vertical removal of the billiard rack from about the balls in the racking operation.

In the conventional racking operation, the balls are placed within the confines of the billiard rack, tightened against the front apex of the rack by pressure with the fingers or thumbs against the rearmost balls, properly located on the playing surface, the rack moved backwards slightly to permit disengagement with the balls and the rack then lifted vertically from about the balls. The billiard rack of the present invention eliminates the vertical lifting of the rack and any contact with the balls by the user while performing the removal of the rack.

Figure 1:
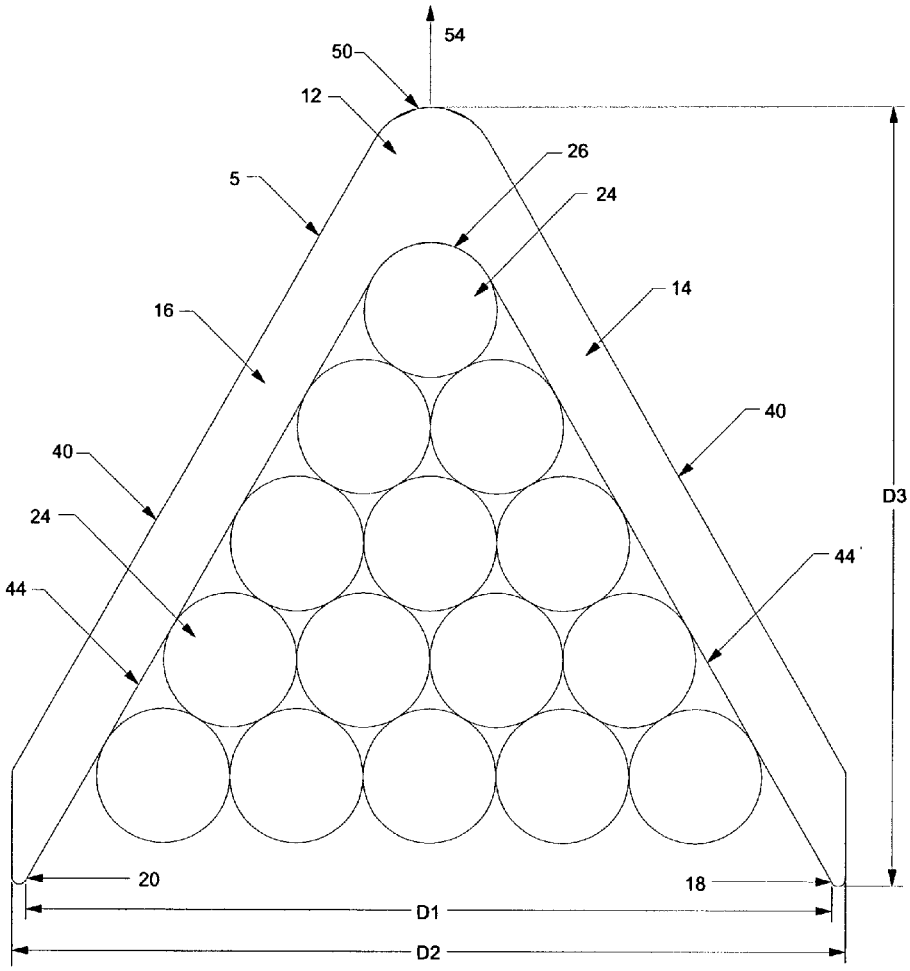
FIG. 1 is a plan view of the billiard rack of the present invention

Turning now to FIG. 1, there is shown a billiard rack 5 with 15 balls 24 that have been tightened against the inside radius 26 at the apex of the billiard rack. Billiard rack 5 of the present invention is generally V-shaped having two arms 14 and 16 that contain balls 24 in the racking operation. The inside edge of arms 14 and 16 here shown as edge 44, are preferably longer than outside edges 40 which outside edges extend from apex 50 to corner 18 in distance D3. In a preferred embodiment, distance D3 is 13 inches. The inside edge 44 of arms 14 and 16 are separated by distance D1 preferably 13⅝ inches and distance D2 between outside flat edges is preferably 14⅛ inches. The arc made by arms 14 and 16 is preferably 60 degrees and is sufficiently sized to contain 15 conventional billiard balls.

Upon the movement in forward direction 54, the rack is removed from contact with the balls due to the V-shape of the rack. As the rack moves in the direction of the arrow, the configuration of the rack causes the distance between the balls and the rack to increase since the V-shape is inversely wide to the width of the racked balls as one moves in direction 54. In this way, the rack can be removed without disturbing the balls.

In a preferred embodiment, the radius of curvature of the outer edge of apex 12 is 1⅛ inches as is the radius of curvature for inner edge of apex 26. This outer edge radius can be of any a number of radii depending on the application and desired appearance of the rack. The radius of the inner edge preferably should be no greater than 1⅛ inch, but it can be less than that depending on the application. Similarly, the radius of curvature of the end 18 of arm 14 and end 20 of arm 16 is ⅛ inch. Distance differential between D1 and D2 permits insertion of thumb and forefinger about the rack to move it in a vertical fashion away from the balls.

Figure 2:
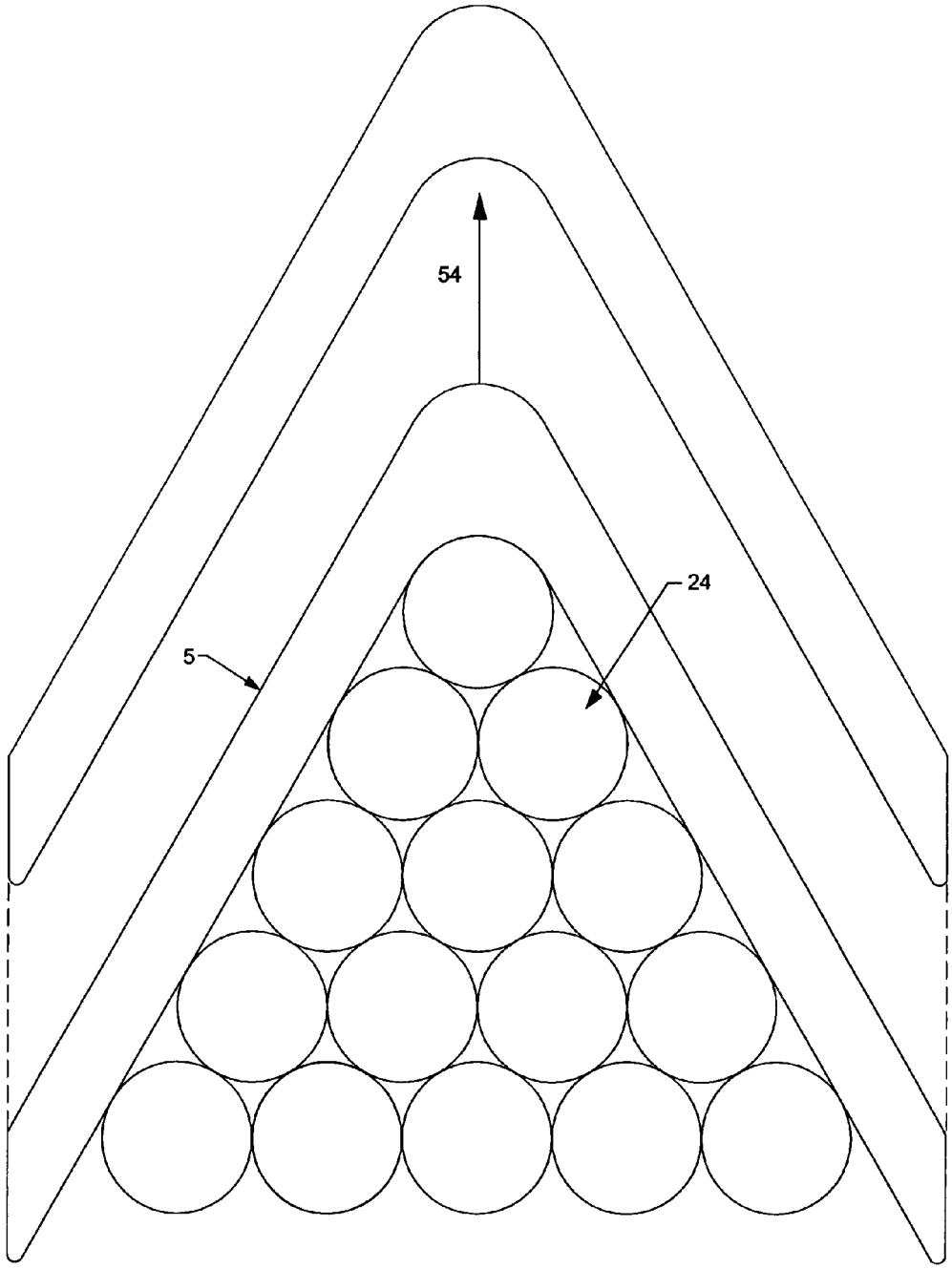
FIG. 2 is a plan view of the billiard rack of the present invention in operation.

FIG. 2 shows rack 5 being moved forward away from balls 24 in direction 54 in a straight motion, thereby moving the rack away from the balls without disturbing the balls. Once the rack is a sufficient distance away from the balls as shown in FIG. 2, it can easily be removed without a risk of touching any of the balls.

Figure 3:
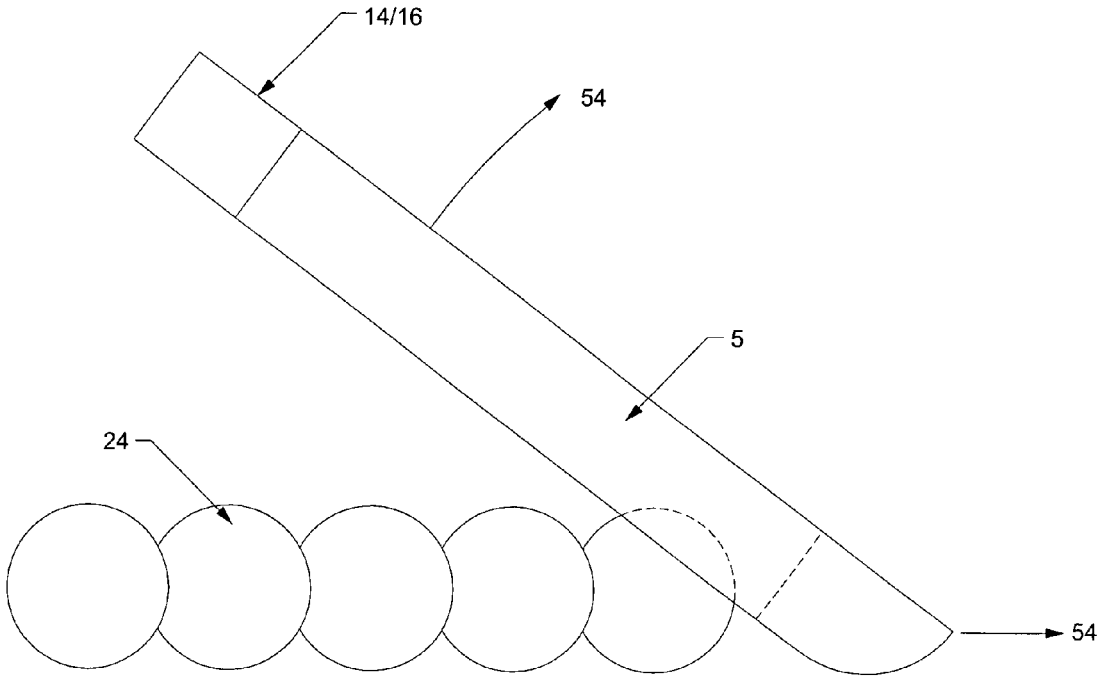
FIG. 3 is a side schematic view of the billiard rack of the present rack in operation.

FIG. 3 shows an additional step that may be employed while removing the rack. In another method of operation, it is also possible to rotate the V-shaped rack 5 away from the user by lifting each of the ends of arms 14 and 16 and at the same time moving the rack forward in direction 54. By this operation, the rack is easily removed away from the balls without disturbing same. In a preferred embodiment, the bottom surface of the apex of V-shaped rack 5 may be curved to facilitate the rotation and lifting of the rack during removal.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method and apparatus for racking billiard balls having a V-shaped ball containment area consisting of:

A) a pair of arms each having an outer and inner side, said arms meeting at an apex having an inner and outer surface, said arms extending from said apex to create an arc of approximately 60 degrees forming a V;

B) said inner side of each arm extending at least as far from the inner surface of said apex a distance equal to approximately five times the diameter of a standard billiard ball;

C) wherein said balls are accessible by a user from the open end of said V;

D) a connecting side that joins said inner and outer sides of said pair of arms, placing said V-shaped anna on a pool table;

moving said billiard balls by the user into said V-shaped device into the opening of the V into a tight formation engaging the sides and apex of said V-shaped device; and moving said V-shaped device away from said balls in the horizontal plane of the table until said V-shaped device is completely removed from about the balls, thereby leaving the balls in a tight triangular formation.

2. The method and apparatus for racking billiard balls of claim 1 said V-shaped ball containment area having a curvature of radius of said apex of 1⅛ inches.

3. The method and apparatus for racking billiard balls of claim 1 wherein said distance between the end of each arm at the inner side is 13⅝ inches.

4. The method and apparatus for racking billiard balls of claim 1 wherein said distance between the end of each arm at the outer side is 14⅛ inches.

5. A method and apparatus for racking billiard balls defining a V-shaped ball containment area and consisting of:

A) a pair of arms forming a V where each arm has an outer and inner sides, a connecting side between said outer and inner sides, said arms meeting at an apex and having extremities away from said apex that create an arc of approximately 60 degrees;

B) said inner side of each arm extending at least as far as a distance equal to 5 times the diameter of a standard billiard ball;

C) said outer side or each arm extending at least as far as the distance equal to 4 times the diameter of a standard billiard ball; and D) a connecting side that joins said inner and outer sides the method further including the steps of:

placing said V-shaped arms on a pool table;

moving 15 billiard balls by the user's thumbs across said table into said V-shaped device into the opening of the V into a tight formation engaging the sides and apex of said V-shaped device; and moving said V-shaped device away from said balls in the horizontal plane of the table until said V-shaped device is completely removed from about the balls, thereby leaving the balls in a tight triangular formation.

6. The method and apparatus for racking billiard balls of claim 5 wherein said apex has a curvature of radius of said inner surface of 1⅛ inches.

7. The method and apparatus for racking billiard balls of claim 5 wherein said distance between the end of the inner side of each arm is 13⅝ inches.

8. The method and apparatus for racking billiard balls of claim 5 wherein said distance between the end of each arm at the outer side is 14⅛ inches.

9. A method and apparatus for racking billiard balls defining a V-shaped ball containment area consisting of:

A) a pair of arms having a generally cylindrical cross section each arm having an outer and inner side, and a top and bottom side, said arms meeting at an apex having an inner and outer surface, said arms extending from said apex to create an arc of approximately 60 degrees;

B) said inner side of each arm extending at least as far from the inner surface of said apex a distance equal to five times the diameter of a standard billiard bail; and the method further including the steps of:

placing said V-shaped arms on a pool table;

moving 15 billiard balls by the user across said table into said V-shaped device into the opening of the V into a tight formation engaging the sides and apex of said V-shaped device;

moving said V-shaped device away from said balls by lifting said pair of arms upwardly until said V-shaped device is completely removed from about the balls, thereby leaving the bails in a tight triangular formation.

10. The method and apparatus for racking billiard balls of claim 9 further comprising a connecting side wherein said outer side of each arm meets said inner side of said arm by said connecting side.

11. The method and apparatus for racking billiard balls of claim 9 further comprising a curved connecting corner wherein said outer side of each arm meets said inner surface at said curved connecting corner.

12. A method for racking balls consisting of:

A) a pair of arms each having an outer and inner side, said arms meeting at an apex having an inner and outer surface, said arms extending from said apex to create an arc of approximately 60 degrees forming a V;

B) said inner side of each arm extending at least as far from the inner surface of said apex a distance equal to approximately five times the diameter of a standard billiard ball;

C) wherein said balls are accessible by a user from above the rack, the method further including the steps of placing said V-shaped arms on a pool table;

moving 15 billiard balls by the user across said table into said V-shaped device into the opening of the V into a tight formation engaging the sides and apex of said V-shaped device; and moving said V-shaped device away from said balls in the horizontal plane of the table until said V-shaped device is completely removed from about the balls, thereby leaving the balls in a tight triangular formation.

13. The method of racking balls as claimed in claim 12 wherein the step of moving said V-shaped device includes lifting the two extended arms of said V upward while moving the V-shaped device forward.

14. The method of racking balls as claimed in claim 12 further comprising pressing said balls into the formation with each of the two thumbs of a user.

* * * * *